US012352283B2

(12) United States Patent
Okada et al.

(10) Patent No.: US 12,352,283 B2
(45) Date of Patent: Jul. 8, 2025

(54) ROTOR AND COMPRESSOR

(71) Applicant: MITSUBISHI HEAVY INDUSTRIES COMPRESSOR CORPORATION, Tokyo (JP)

(72) Inventors: Noriyuki Okada, Tokyo (JP); Nobuyori Yagi, Tokyo (JP); Hideki Nagao, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 18/352,654

(22) Filed: Jul. 14, 2023

(65) Prior Publication Data

US 2024/0026895 A1 Jan. 25, 2024

(30) Foreign Application Priority Data

Jul. 25, 2022 (JP) ..... 2022-117986

(51) Int. Cl.
*F04D 29/26* (2006.01)
*F04D 19/02* (2006.01)
*F04D 29/32* (2006.01)

(52) U.S. Cl.
CPC ..... *F04D 29/266* (2013.01); *F04D 19/02* (2013.01); *F04D 29/322* (2013.01)

(58) Field of Classification Search
CPC ..... F04D 29/266; F04D 19/02; F04D 29/322; F04D 29/053; F04D 17/122; F04D 29/624
See application file for complete search history.

(56) References Cited

U.S. PATENT DOCUMENTS 8,967,960 B2 3/2015 Guenard
10,718,212 B2 7/2020 Jahrmarcht et al.
(Continued)

FOREIGN PATENT DOCUMENTS

FR 2976615 A1 * 12/2012 ..... F01D 5/066
JP H051567 A * 6/1991
(Continued)

OTHER PUBLICATIONS

Miyashita et al (JP H051567) machine translation (Year: 1991).*
Arrow Gear Curvic Couplings YouTube Video, Jun. 18, 2009, https://www.youtube.com/watch?v=SaetXBZqXNA (Year: 2009).*

*Primary Examiner* — Brian Christopher Delrue
(74) *Attorney, Agent, or Firm* — Osha Bergman Watanabe & Burton LLP

(57) ABSTRACT

A rotor includes a bolt fixing portion having a plurality of bolts for collectively fixing a plurality of impellers including a disk having a central shaft structure. The disk has a first fitting portion having a plurality of first protrusion portions and first recessed portions, a second fitting portion having a plurality of second protrusion portions and second recessed portions, and a plurality of bolt holes through which the first fitting portion and the second fitting portion pass and into which the bolt is inserted. The first protrusion portion is fitted into the second recessed portion of another adjacent impeller in a state where movement in the circumferential direction is restricted to each other, and the first recessed portion is fitted to the second protrusion portion of another adjacent impeller in a state where movement in the circumferential direction is restricted to each other.

7 Claims, 9 Drawing Sheets

(56) References Cited

U.S. PATENT DOCUMENTS

| | | | | |
|---|---|---|---|---|
| 12,071,854 | B2 * | 8/2024 | Descubes | F01D 21/045 |
| 2003/0133786 | A1 | 7/2003 | Uematsu et al. | |
| 2009/0214331 | A1 * | 8/2009 | Jewess | F02K 3/00 415/198.1 |
| 2014/0193266 | A1 * | 7/2014 | Krishnamurthy | B05D 7/14 427/523 |
| 2015/0053526 | A1 * | 2/2015 | Brathwaite | B23F 15/06 192/108 |
| 2015/0118048 | A1 * | 4/2015 | Kington | F01D 5/048 29/889.21 |
| 2022/0268292 | A1 | 8/2022 | Nagao | |

FOREIGN PATENT DOCUMENTS

| | | | |
|---|---|---|---|
| JP | 2002-206402 | A | 7/2002 |
| JP | 2003-206701 | A | 7/2003 |
| JP | 2022-129731 | A | 9/2022 |

* cited by examiner

ROTOR AND COMPRESSOR

BACKGROUND OF THE INVENTION

Field of the Invention

The present disclosure relates to a rotor and a compressor.

Priority is claimed on Japanese Patent Application No. 2022-117986, filed on Jul. 25, 2022, the content of which is incorporated herein by reference.

Description of Related Art

Generally, a centrifugal compressor includes a rotor having a plurality of impellers and a casing that forms a flow path between the impellers and the casing by covering the impellers from the outside. In the centrifugal compressor, a fluid supplied from the outside through the flow path formed in the casing is compressed by rotations of the impellers.

For example, as described in Patent Document 1, in such a centrifugal compressor, a rotor is formed by stacking a plurality of impellers in an axial direction. In this centrifugal compressor, the plurality of stacked impellers are fixed by a large bolt, which is a shaft disposed to insert a large hole formed in centers of the impellers.

CITATION LIST

Patent Document

[Patent Document 1] U.S. Pat. No. 8,967,960

SUMMARY OF THE INVENTION

By the way, when the large hole into which the shaft is inserted is opened in the centers of the impeller as described above, a thin portion is formed around the hole. Then, a load due to a centrifugal force when the rotor is rotated acts mainly on the thin portion around the hole. Further, this load increases in proportion to a centrifugal force that increases as a rotation speed of the rotor increases. Therefore, when an attempt is made to rotate the rotor having the impellers fixed by a shaft at a high speed, the impellers cannot withstand a large load due to the centrifugal force and may be damaged.

The present disclosure provides a rotor and compressor capable of improving strength of the impeller against a load due to a centrifugal force while rotating stably at high speed.

According to an aspect of the present disclosure, there is provided a rotor rotatable about an axis, including: a plurality of impellers that each include a disk having a central shaft structure having a buried center and formed in a disk shape centered on the axis, and are adjacent to each other in an axial direction in which the axis extends, and a bolt fixing portion having a plurality of bolts that collectively fix the plurality of impellers arranged in the axial direction, in which the disk includes a first fitting portion having a plurality of first protrusion portions that protrude in the axial direction from a surface facing a first side in the axial direction and a plurality of first recessed portions that are recessed in the axial direction from the surface facing a first side in the axial direction, a second fitting portion that is formed at a position overlapping the first fitting portion when viewed from the axial direction and has a plurality of second protrusion portions that protrude in the axial direction from a surface facing a second side in the axial direction and a plurality of second recessed portions that are recessed in the axial direction from a surface facing the second side in the axial direction, and a plurality of bolt holes which is formed so that the first fitting portion and the second fitting portion pass through in the axial direction and through which the bolt is inserted, each of the plurality of first protrusion portions and each of the plurality of first recessed portions are disposed alternately in a circumferential direction centered on the axis at a position deviated from the axis when viewed in the axial direction, each of the plurality of second protrusion portions and each of the plurality of second recessed portions are disposed alternately in the circumferential direction at a position deviated from the axis when viewed from the axial direction, each of the plurality of first protrusion portions is fitted into each of the plurality of second recessed portions of another adjacent impeller in a state where movement in the circumferential direction is restricted to each other, and each of the plurality of first recessed portions is fitted into each of the plurality of second protrusion portions of another adjacent impeller in a state where movement in the circumferential direction is restricted to each other.

Further, according to another aspect of the present disclosure, there is provided a compressor including: the rotor; and a casing configured to cover the rotor from an outside in a radial direction with reference to the axis.

According to the rotor and compressor of the present disclosure, it is possible to improve strength of the impeller against a load due to a centrifugal force while rotating the rotor stably at high speed.

DETAILED DESCRIPTION OF THE INVENTION

In the following, embodiments of a compressor according to the present disclosure will be described with reference to the accompanying drawings. However, the present disclosure is not limited to the embodiments.

First Embodiment (Configuration of Compressor)

Figure 1:
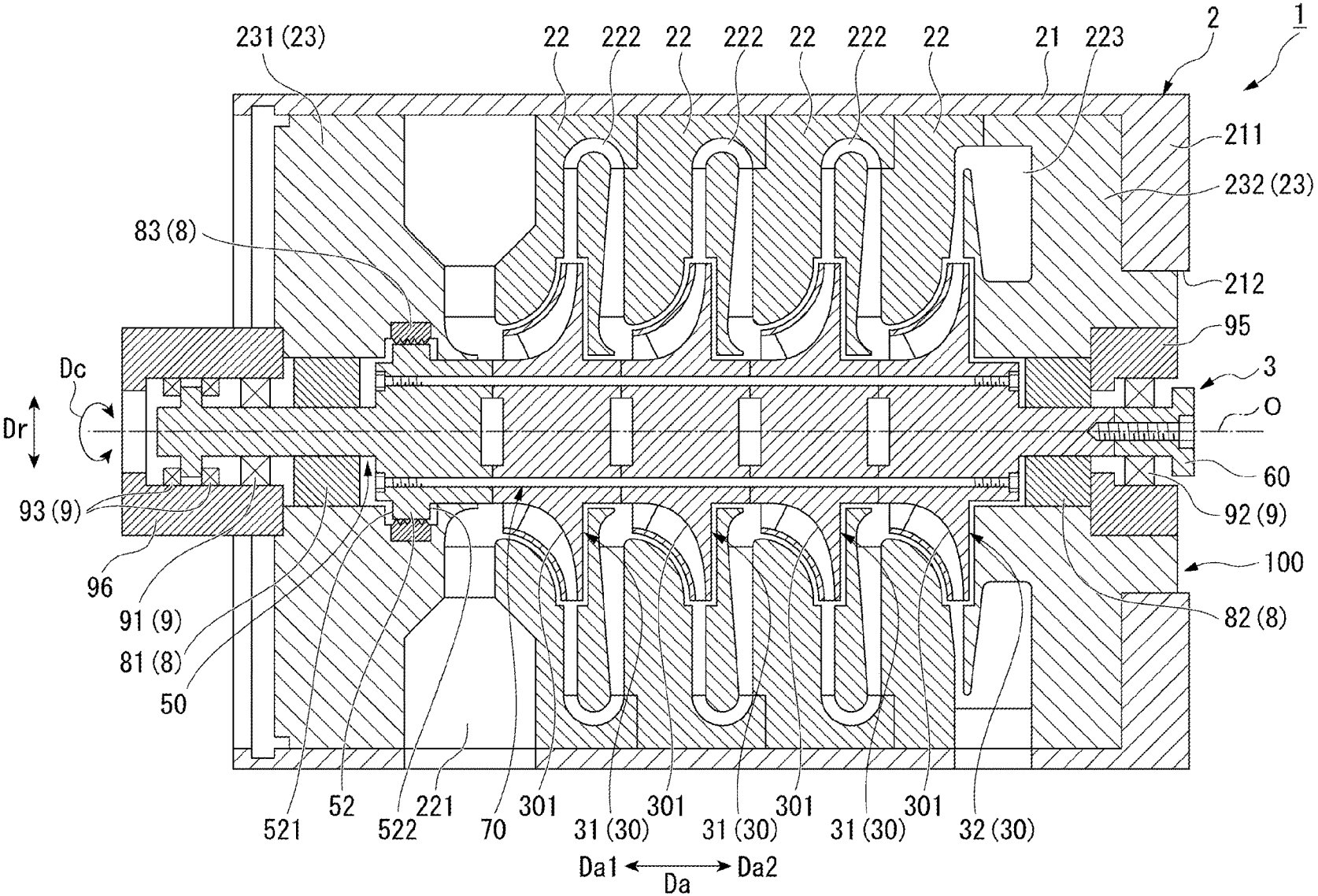
FIG. 1 is a cross-sectional view showing a schematic configuration of a compressor according to one embodiment of the present disclosure.

A compressor 1 compresses a gas as a working fluid. The compressor 1 of the present embodiment is a uniaxial multi-stage centrifugal compressor (multi-stage centrifugal compressor) that compresses hydrogen gas. As shown in FIG. 1, the compressor 1 includes a casing 2, a rotor 3, a seal portion 8, and a bearing portion 9.

In the following, a direction in which an axis O of the rotor 3 described below extends is referred to as an axial direction Da. A radial direction of the compressor 1 with reference to the axis O is simply referred to as a radial direction Dr. Further, a direction around the rotor 3 centered on the axis O is defined as a circumferential direction Dc.

(Configuration of Casing)

The casing 2 covers the rotor 3 from the outside in the radial direction Dr. The casing 2 of the present embodiment has an outer casing 21, a plurality of diaphragms 22, and a plurality of heads 23.

The outer casing 21 has a cylindrical shape centered on a central axis disposed in the same manner as the axis O of the rotor 3. A first side Da1 (one side) of the outer casing 21 in the axial direction Da is opened with a size that allows a bundle 100, which will be described below, to be inserted. An end plate 211 is formed on a second side Da2 (the other side) of the outer casing 21 in the axial direction Da. The end plate 211 has a plate shape extending to be orthogonal to the axial direction Da. An insertion hole 212 having a size in which the rotor 3 can be inserted and the bundle 100 cannot be inserted is formed in a central portion of the end plate 211. As a result, the bundle 100 can be inserted into and removed from the casing 2 by being moved in the axial direction Da with respect to the outer casing 21.

The plurality of diaphragms 22 are disposed to cover the rotor 3 from the outside in the radial direction Dr. The plurality of diaphragms 22 are disposed inside the outer casing 21. The diaphragm 22 has an annular shape centered on the axis O. The plurality of diaphragms 22 are stacked to form a tubular body extending in the axial direction Da. Outer peripheral surfaces of the adjacent diaphragms 22 are fixed to each other by welding or a bolt 71. By fixing the plurality of diaphragms 22 to each other, a flow path to be introduced into the impeller 30 is formed inside. Further, the plurality of diaphragms 22 form the bundle 100 together with the head 23, the rotor 3, the seal portion 8, and the bearing portion 9. The bundle 100 is accommodated in the outer casing 21. In the bundle 100, the rotor 3, the plurality of diaphragms 22, the plurality of heads 23, the seal portion 8, and the bearing portion 9 are made movable together to be integrated with each other.

(Configuration of Flow Path)

Here, specifically, the flow path formed in the casing 2 by the diaphragms 22 will be described in order from an upstream side, which is the first side Da1 in the axial direction Da, to a downstream side, which is the second side Da2 in the axial direction Da. In the present embodiment, the diaphragms 22 form a suction port 221, a plurality of casing flow paths 222, and a discharge port 223 together with the outer casing 21 in this order from the upstream side through which the gas flows.

The suction port 221 allows an uncompressed gas that has flowed in from the outside of the casing 2 to flow into the inside of the diaphragm 22. The gas before flowing into the most upstream impeller 30 flows through the suction port 221. An inlet guide vane is disposed at the suction port 221.

The casing flow path 222 is formed in the diaphragm 22. The gas is supplied from the suction port 221 to the most upstream impeller 30, the gas discharged from the upstream impeller 30 is supplied to the impeller 30 disposed on the downstream side, and the gas discharged from the most downstream impeller 30 is fed to the discharge port 223, through the casing flow path 222.

The discharge port 223 discharges the compressed gas flowing inside the diaphragm 22 to the outside of the casing 2. The discharge port 223 discharges the gas discharged from the most downstream impeller 30 to the outside.

Each of the pair of heads 23 is a member having an annular shape and is disposed inside the outer casing 21. The head 23 is formed in a size capable of closing the openings at both ends of the outer casing 21. The head 23 of the present embodiment includes a suction-side head 231 disposed on the first side Da1 in the axial direction Da with respect to the plurality of diaphragms 22 and a discharge-side head 232 disposed on the second side Da2 in the axial direction Da with respect to the plurality of diaphragms 22.

The suction-side head 231 is disposed at a position closer to the suction port 221 than the discharge-side head 232. The suction-side head 231 forms the suction port 221 together with a diaphragm 22 disposed to be closest to the first side Da1 in the axial direction Da. The suction-side head 231 is fixed to the plurality of integrated diaphragms 22 by bolts 71 or the like. As a result, the suction-side head 231 is integrated with the diaphragms 22.

The discharge-side head 232 is disposed at a position closer to the discharge port 223 than the suction-side head 231. The discharge-side head 232 forms the discharge port 223 together with a diaphragm 22 disposed to be closest to the second side Da2 in the axial direction Da. The discharge-side head 232 is fixed to the plurality of integrated diaphragms 22 by the bolts 71 or the like. As a result, the discharge-side head 232 is integrated with the diaphragms 22.

(Configuration of Rotor)

Figure 2:
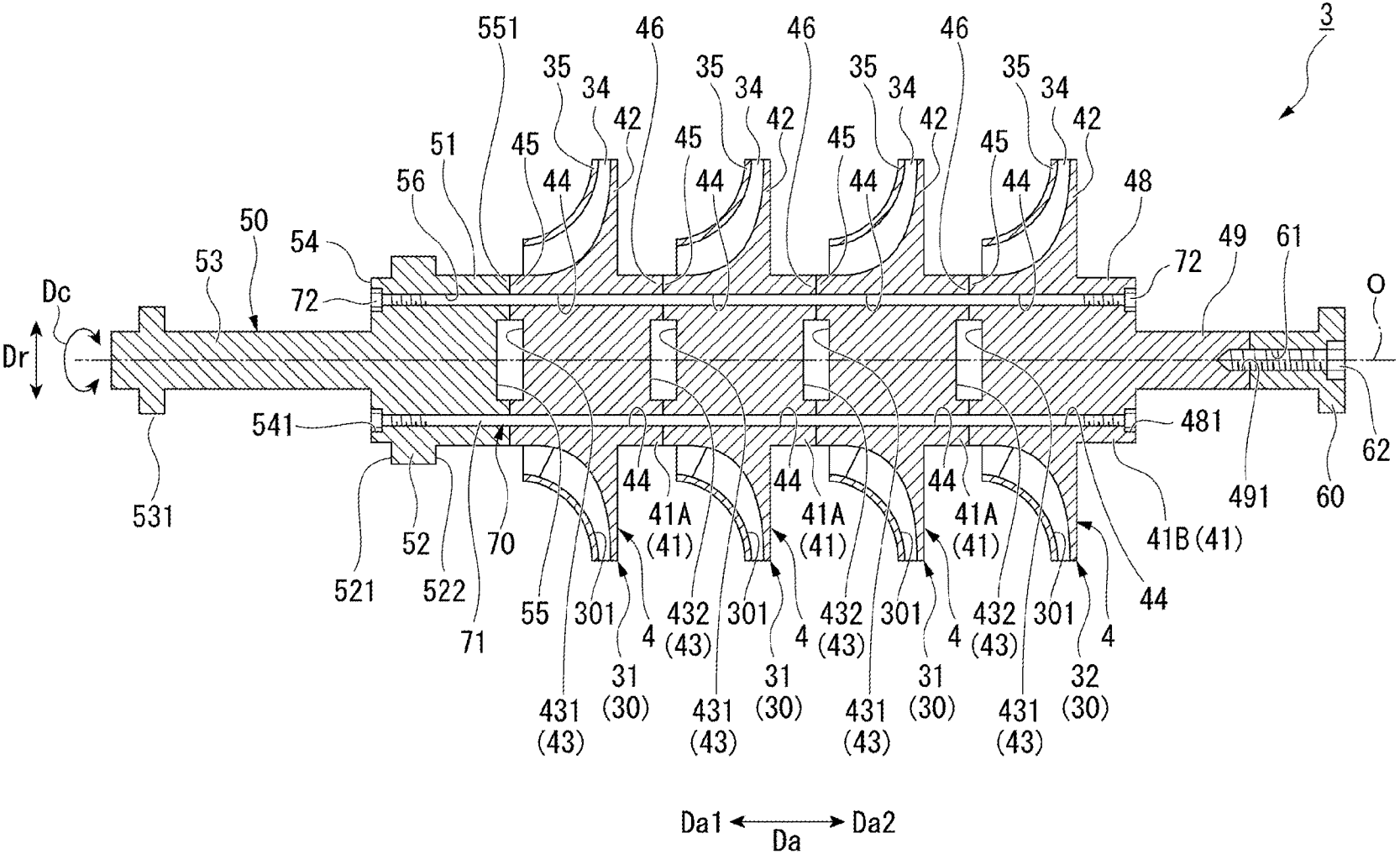
FIG. 2 is a cross-sectional view showing a rotor of the present embodiment.

The rotor 3 is accommodated inside the casing 2. The rotor 3 is rotatable centered on the axis O. As shown in FIG. 2, the rotor 3 of the present embodiment includes the plurality of impellers 30, a balance piston 50, a coupling hub 60, and a bolt fixing portion 70.

The impeller 30 uses a centrifugal force to compress the gas by rotating. The plurality of impellers 30 are adjacent to each other in the axial direction Da. The impeller 30 is a so-called closed impeller including a disk 4, a blade 34, and a cover 35. Hereinafter, a basic configuration of the impeller 30 will be described with reference to FIGS. 3 to 7 showing a first impeller 31 described below.

Figure 3:
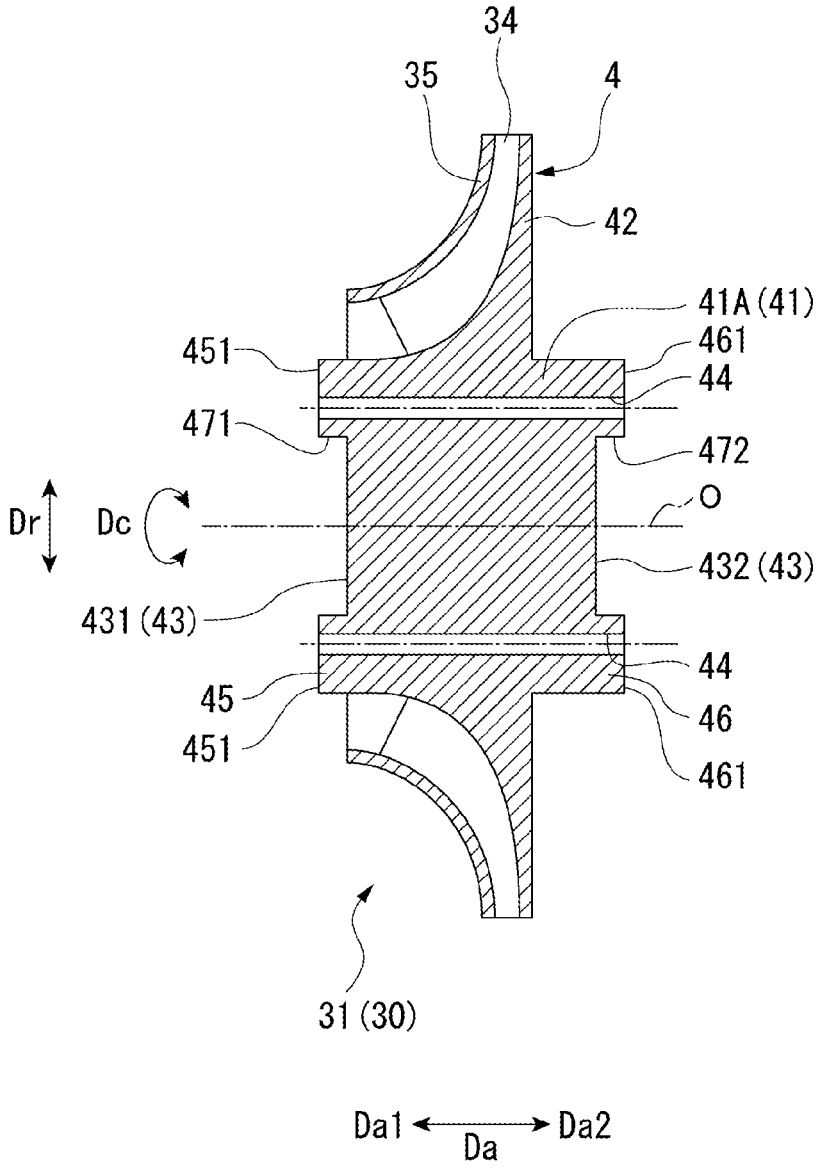
FIG. 3 is a cross-sectional view showing a first impeller of a first embodiment.

As shown in FIG. 3, the disk 4 is formed in a disk shape centered on the axis O and has a central shaft structure having a buried center. The disk 4 of the present embodiment has a disk shaft portion 41 and a disk outer peripheral portion 42.

The disk shaft portion 41 is a solid portion of the disk 4 including a central portion. The disk shaft portion 41 is formed in a circular cross section centered on the axis O. The disk shaft portion 41 of the present embodiment includes a disk surface 43, a first fitting portion 45, a second fitting portion 46, a first central recessed portion 471, a second central recessed portion 472, and a bolt hole 44.

At least one disk surface 43 is formed on the disk shaft portion 41. The disk surface 43 is a flat surface centered on the axis O when viewed from the axial direction Da. The disk surface 43 faces the axial direction Da. The disk surfaces 43 face each other in the axial direction Da between the adjacent impellers 30. That is, in a state where the plurality of impellers 30 are adjacent to each other in the axial direction Da, the disk surface 43 of one impeller 30 and the disk surface 43 of another impeller 30 adjacent to the one impeller 30 face each other in the axial direction Da.

Figure 4:
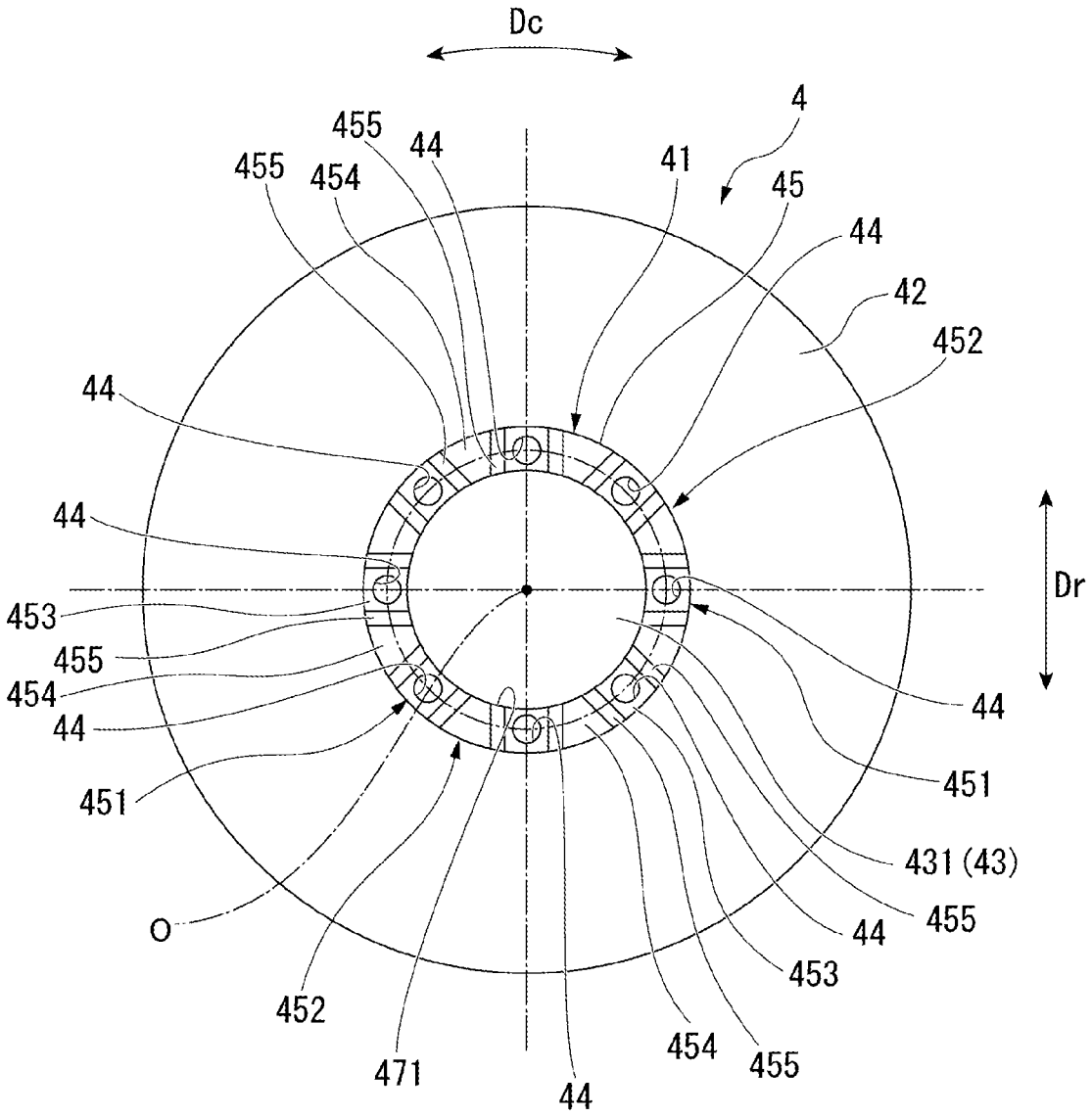
FIG. 4 is a view showing a state where a disk portion of the first impeller of FIG. 3 is viewed from a first side in an axial direction.
Figure 5:
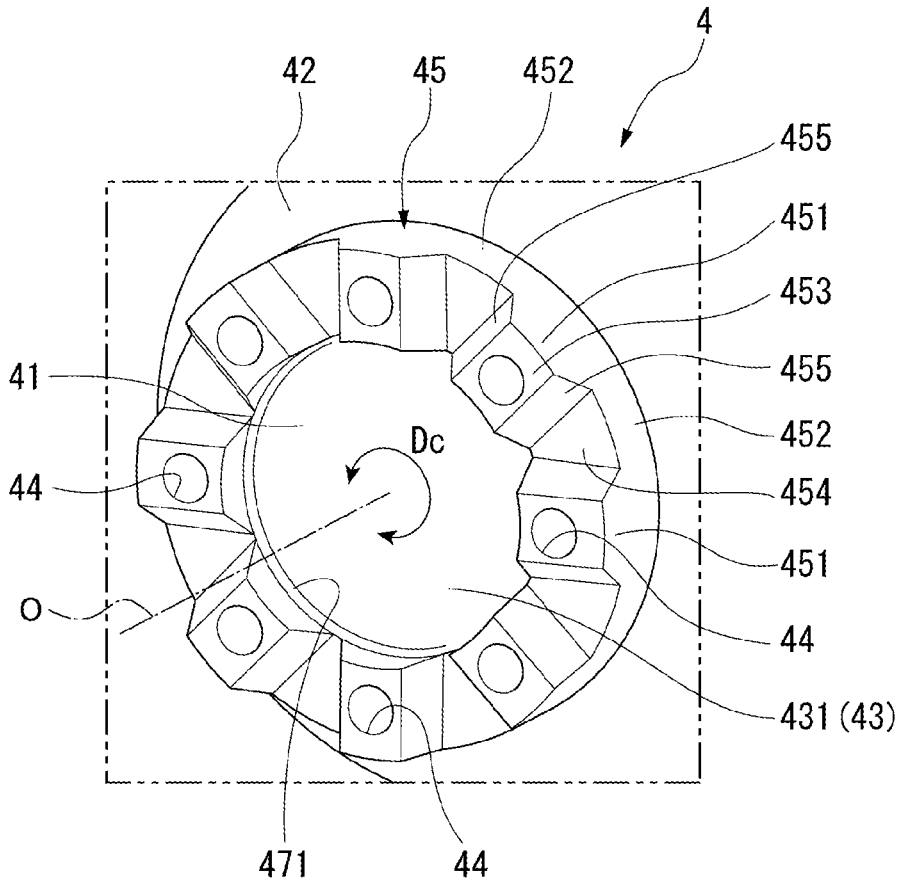
FIG. 5 is a perspective view showing a first fitting portion of the first impeller.

The first fitting portion 45 protrudes or is recessed in the axial direction Da and is fitted into the second fitting portion 46 of another adjacent impeller 30 so that movement in the circumferential direction Dc is restricted to each other. As shown in FIGS. 4 and 5, the first fitting portion 45 is a plurality of first protrusion portions 451 protruding in the axial direction Da and a plurality of first recessed portions 452 recessed in the axial direction Da from a surface (first surface) facing the first side Da1 in the axial direction Da (eight first protrusion portions 451 and eight first recessed portions 452 in the present embodiment). The first fitting portions 45 are formed on the disk surface 43 (first disk surface 431 to be described later) facing the first side Da1 in the axial direction Da. The first fitting portions 45 form a region having annular shape centered on the axis O at positions deviated to the outside in the radial direction Dr from the axis O when viewed from the axial direction Da.

Figure 7:
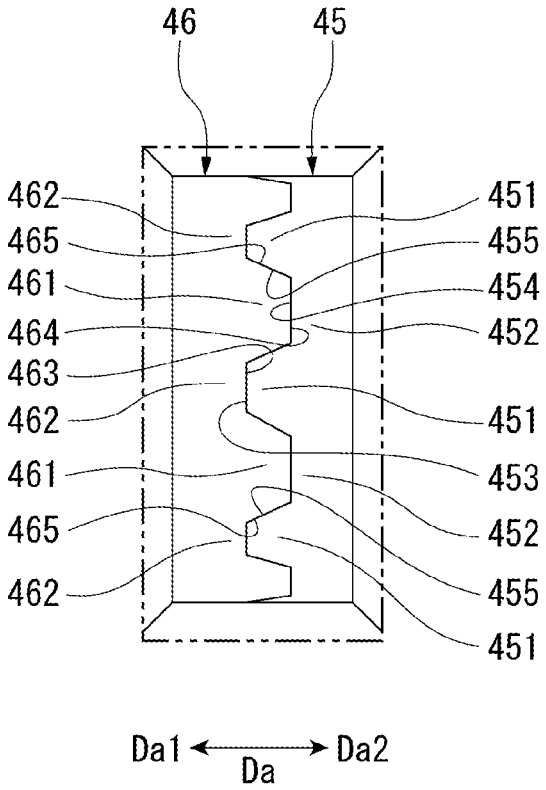
FIG. 7 is an enlarged view of a main part showing a state where a first fitting portion and a second fitting portion of the adjacent first impeller are fitted into each other.

The first protrusion portion 451 and the first recessed portion 452 are disposed alternately in the circumferential direction Dc centered on the axis O at positions deviated from the axis O when viewed from the axial direction Da. As shown in FIG. 7, the first protrusion portion 451 protrudes from the disk surface 43 to the first side Da1 in the axial direction Da. The plurality of first protrusion portions 451 are disposed to be evenly spaced apart in the circumferential direction Dc. The first protrusion portion 451 of one impeller 30 is fitted into a second recessed portion 462 to be described later of another impeller 30 which is adjacent to the one impeller 30 in a state where movement in the circumferential direction Dc is restricted to each other. The first recessed portion 452 is recessed with respect to the first protrusion portion 451 on the second side Da2 in the axial direction Da. The plurality of first recessed portions 452 are disposed to be evenly spaced apart in the circumferential direction Dc. The first recessed portion 452 of one impeller 30 is fitted into a second protrusion portion 461 to be described later of another impeller 30 adjacent to the impeller 30 at that position in a state where movement in the circumferential direction Dc is restricted to each other.

Further, as shown in FIGS. 4, 5 and 7, the first fitting portion 45 includes a plurality of first hole forming surfaces 453, a plurality of first separation surfaces 454, a plurality of first connection surfaces 455, and a first central recessed portion 471. The plurality of first protrusion portions 451 and the plurality of first recessed portions 452 are formed by the plurality of first hole forming surfaces 453, the plurality of first separation surfaces 454, and the plurality of first connection surfaces 455.

The bolt hole 44 is formed in the first hole forming surface 453. The first hole forming surface 453 of the present embodiment is a flat surface facing the first side Da1 in the axial direction Da. The first hole forming surface 453 is formed to have a size so that the bolt hole 44 is internally accommodated when viewed from the axial direction Da. The first hole forming surface 453 is a top surface of the first protrusion portion 451 located closest to the first side Da1 in the axial direction Da.

The first separation surface 454 is disposed apart in the circumferential direction Dc with respect to the first hole forming surface 453 to be alternately arranged with respect to the first hole forming surface 453 when viewed from the axial direction Da. The first separation surface 454 is formed at a position shifted in the axial direction Da with respect to the first hole forming surface 453. The first separation surface 454 of the present embodiment is formed at a position shifted to the second side Da2 in the axial direction Da with respect to the first hole forming surface 453. The first separation surface 454 is a flat surface facing the first side Da1 in the axial direction Da. The first separation surface 454 is formed smaller than the first hole forming surface 453 when viewed from the axial direction Da. The first separation surface 454 is a bottom surface of the first recessed portions 452 located closest to the second side Da2 in the axial direction Da.

The first connection surface 455 is disposed between the first hole forming surface 453 and the first separation surface 454 in the circumferential direction Dc. The first connection surface 455 is connected to the first hole forming surface 453 and the first separation surface 454. The first connection surface 455 of the present embodiment is formed as a flat surface so that a connection line with the first hole forming surface 453 and a connection line with the first separation surface 454 becomes linear when viewed from the axial direction Da. That is, the first connection surface 455 is an inclined surface that faces the axial direction Da and the circumferential direction Dc and extends straight in the radial direction Dr.

The first protrusion portion 451 is formed by the first hole forming surface 453 and the two first connection surfaces 455. The first recessed portion 452 is formed by the first separation surface 454 and the two first connection surfaces 455. In the first fitting portion 45, the first hole forming surface 453, the first connection surface 455, the first separation surface 454, the first connection surface 455, and the first hole forming surface 453 are repeatedly arranged in this order in the circumferential direction Dc. Therefore, the plurality of first protrusion portion 451 and the plurality of first recessed portions 452 are formed in a shape like a Hirth coupling.

The first central recessed portion 471 is an inner region in the radial direction Dr with respect to the first protrusion portion 451 and the first recessed portion 452 when viewed from the axial direction Da. That is, the first central recessed portion 471 is a region surrounded by the first fitting portions 45 in the radial direction Dr. The first central recessed portion 471 is recessed to the second side Da2 in the axial direction Da with respect to the first recessed portion 452. The bottom surface of the first central recessed portion 471 in the axial direction Da is a partial region of the disk surface 43. Therefore, the disk surface 43, which is the bottom surface of the first central recessed portion 471, is located on the second side Da2 in the axial direction Da with respect to the first separation surface 454. The first central recessed portion 471 is formed to be separated in the axial direction Da with respect to another adjacent disk 4.

Figure 6:
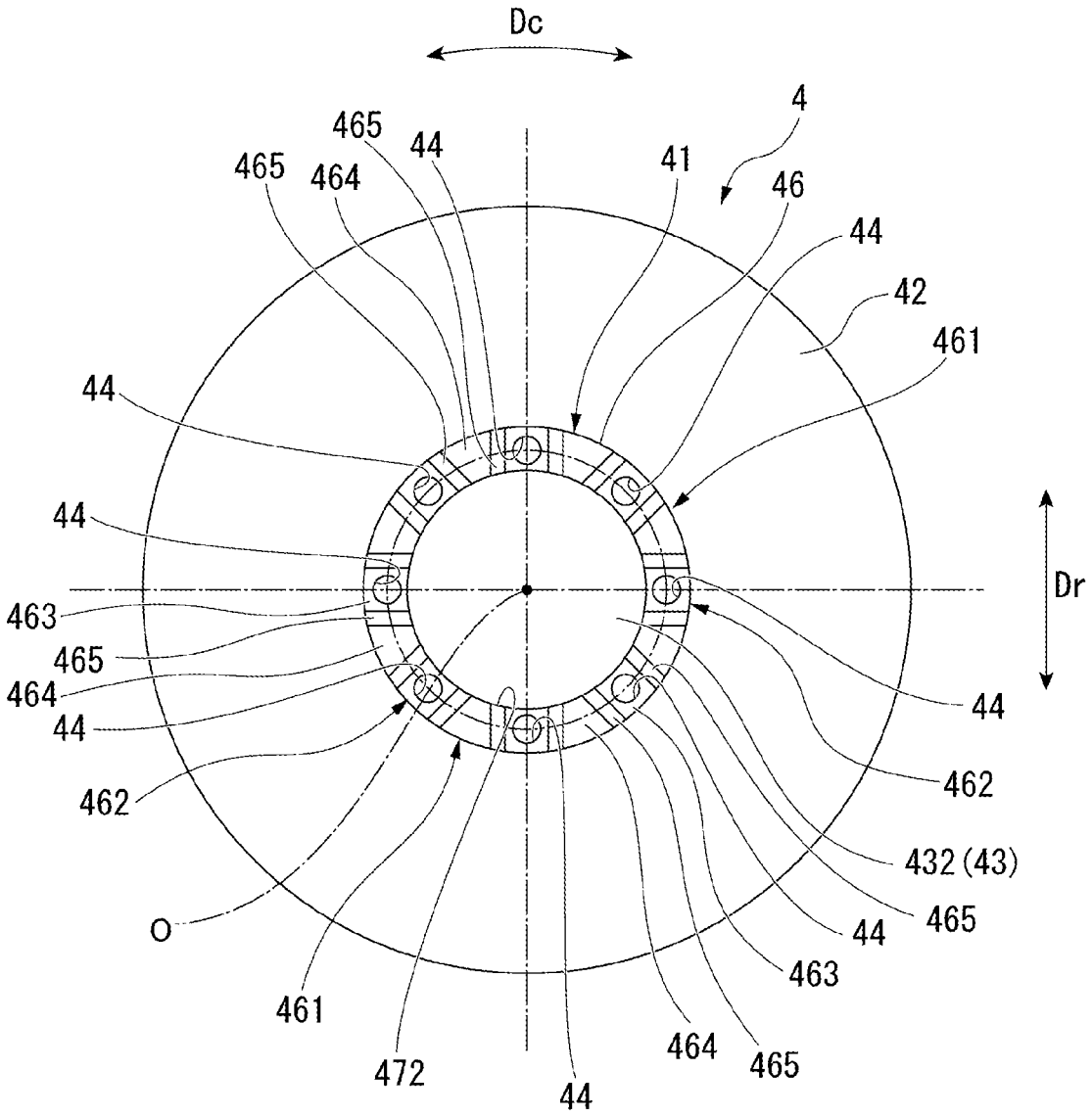
FIG. 6 is a view showing a state where the disk portion of the first impeller of FIG. 3 is viewed from a second side in the axial direction.

As shown in FIGS. 6 and 7, the second fitting portion 46 is a plurality of second protrusion portions 461 protruding in the axial direction Da and a plurality of second recessed portions 462 recessed in the axial direction Da from a surface (second surface) facing the second side Da2 in the axial direction Da (eight second protrusion portions 461 and eight second recessed portions 462 in the present embodiment). The second fitting portion 46 is formed on a disk surface 43 (second disk surface 432 which will be described later) facing a second side Da2 in the axial direction Da. The second fitting portion 46 form a region having annular shape centered on the axis O at positions deviated to the outside in the radial direction Dr from the axis O when viewed from the axial direction Da. The second fitting portion 46 is formed at a position overlapping the first fitting portion 45 when viewed from the axial direction Da.

The second protrusion portion 461 and the second recessed portion 462 are disposed alternately in the circumferential direction Dc centered on the axis O at positions deviated from the axis O when viewed from the axial direction Da. The second protrusion portion 461 protrudes from the disk surface 43 to the second side Da2 in the axial direction Da. The plurality of second protrusion portions 461 are disposed to be evenly spaced apart in the circumferential direction Dc. The second protrusion portion 461 is disposed at a position overlapping the first recessed portion 452 when viewed from the axial direction Da. The second recessed portion 462 is recessed to the first side Da1 in the axial direction Da with respect to the second protrusion portion 461. The plurality of second recessed portions 462 are disposed to be evenly spaced apart in the circumferential direction Dc. The second recessed portion 462 is disposed at a position overlapping the first protrusion portion 451 when viewed from the axial direction Da.

In addition, the second fitting portion 46 has a plurality of second hole forming surfaces 463, a plurality of second separation surfaces 464, a plurality of second connection surfaces 465, and a second central recessed portion 472. The plurality of second protrusion portions 461 and the plurality of second recessed portions 462 are formed by the plurality of second hole forming surfaces 463, the plurality of second separation surfaces 464, and the plurality of second connection surfaces 465.

The bolt hole 44 is formed in the second hole forming surface 463. The second hole forming surface 463 of the present embodiment is a flat surface facing the second side Da2 in the axial direction Da. The second hole forming surface 463 is formed to have a size so that the bolt hole 44 is internally accommodated when viewed from the axial direction Da. The second hole forming surface 463 is formed to have the same size as the first hole forming surface 453 when viewed from the axial direction Da. In addition, the second hole forming surface 463 is disposed at a position overlapping the first hole forming surface 453 when viewed from the axial direction Da. The second hole forming surface 463 is a bottom surface of the second recessed portion 462 located closest to the first side Da1 in the axial direction Da.

The second separation surface 464 is disposed apart in the circumferential direction Dc with respect to the second hole forming surface 463 to be alternately aligned with the second hole forming surface 463 when viewed from the axial direction Da. The second separation surface 464 is formed at a position shifted in the axial direction Da with respect to the second hole forming surface 463. The second separation surface 464 of the present embodiment is formed at a position shifted to the second side Da2 in the axial direction Da with respect to the second hole forming surface 463. The second separation surface 464 is a flat surface facing the second side Da2 in the axial direction Da. The second separation surfaces 464 are formed smaller than the second hole forming surface 463 when viewed from the axial direction Da. The second separation surface 464 is formed to have the same size as the first separation surface 454 when viewed from the axial direction Da. The second separation surface 464 is a top surface of the second protrusion portion 461 located closest to the second side Da2 in the axial direction Da. The second separation surface 464 is disposed at a position overlapping the first separation surface 454 when viewed from the axial direction Da.

The second connection surface 465 is disposed between the second hole forming surface 463 and the second separation surface 464 in the circumferential direction Dc. The second connection surface 465 is connected to the second hole forming surface 463 and the second separation surface 464. The second connection surface 465 of the present embodiment is formed as a flat surface so that a connection line with the second hole forming surface 463 and a connection line with the second separation surface 464 are linear when viewed from the axial direction Da. That is, the second connection surface 465 is an inclined surface that faces the axial direction Da and the circumferential direction Dc and extends straight in the radial direction Dr. The second connection surface 465 is disposed at a position overlapping the first connection surface 455 when viewed from the axial direction Da. The second connection surface 465 is formed to have the same size as the first connection surface 455 when viewed from the axial direction Da.

The second recessed portion 462 is formed by the second hole forming surface 463 and the two second connection surfaces 465. The second protrusion portion 461 is formed by the second separation surface 464 and the two second connection surfaces 465. Therefore, in the second fitting portion 46, an arrangement order of the second protrusion portion 461 and the second recessed portion 462 in the circumferential direction Dc is opposite to an arrangement order of the first protrusion portion 451 and the first recessed portion 452 in the circumferential direction Dc of the first fitting portion 45. In the second fitting portion 46, the second hole forming surface 463, the second connection surface 465, the second separation surface 464, the second connection surface 465, and the second hole forming surface 463 are repeatedly arranged in this order in the circumferential direction Dc. Therefore, the plurality of second recessed portions 462 and the plurality of second protrusion portions 461 are formed in a shape like a Hirth coupling. As shown in FIG. 7, the second fitting portion 46 is fitted into the first fitting portions 45 of another adjacent impeller 30 so that movement in the circumferential direction Dc is restricted to each other.

When the second fitting portion 46 is fitted into the first fitting portion 45 of another adjacent impeller 30, the first protrusion portion 451 is fitted into the second recessed portion 462 of the other adjacent impeller 30 in a state where movement in the circumferential direction Dc is restricted to each other. Then, the first hole forming surface 453 faces the second hole forming surface 463. In addition, the first recessed portion 452 is fitted into the second protrusion portion 461 of another adjacent impeller 30 in a state where movement in the circumferential direction Dc is restricted to each other. Then, the first separation surface 454 faces the second separation surface 464. Furthermore, the first connection surface 455 and the second connection surface 465 are in contact with each other. Although the first connection surface 455 and the second connection surface 465 face each other at a plurality of points, all the first connection surfaces 455 and the second connection surface 465 may not be in contact with each other. That is, in a case where the first fitting portion 45 and the second fitting portion 46 are fitted into each other, at least some of the plurality of first connection surfaces 455 may be in contact with the plurality of second connection surfaces 465 of another adjacent impeller 30.

As shown in FIG. 6, the second central recessed portion 472 is an inner region in the radial direction Dr with respect to the second protrusion portion 461 and the second recessed portion 462 when viewed from the axial direction Da. That is, the second central recessed portion 472 is a region surrounded by the second fitting portion 46 in the radial direction Dr. The second central recessed portion 472 is recessed to the first side Da1 in the axial direction Da with respect to the second recessed portion 462. The bottom surface of the second central recessed portion 472 in the axial direction Da is a partial region of the disk surface 43. Therefore, the disk surface 43, which is the bottom surface of the second central recessed portion 472, is located on the first side Da1 in the axial direction Da with respect to the second separation surface 464. The second central recessed portion 472 is formed to be separated in the axial direction Da with respect to another adjacent disk 4. That is, in the adjacent impellers 30, a space is formed between the first central recessed portion 471 of one impeller 30 and the second central recessed portion 472 of another impeller 30 adjacent to the one impeller 30.

As shown in FIG. 3, the bolt hole 44 is a through hole into which the bolt 71, which will be described later, is inserted. A plurality of the bolt holes 44 are formed to pass through the first fitting portion 45 and the second fitting portion 46 in the axial direction Da at a position shifted outward with respect to the axis O in the radial direction Dr. More specifically, the bolt hole 44 is formed to pass through the first hole forming surface 453 and the second hole forming surface 463. As shown in FIGS. 4, 5, and 6, the plurality of the bolt holes 44 (eight bolt holes 44 in the present embodiment) are formed in the circumferential direction Dc with respect to the first fitting portion 45 and the second fitting portion 46. The bolt hole 44 of the present embodiment is formed only on the first hole forming surface 453 and the second hole forming surface 463. Only one bolt hole 44 is formed for one first hole forming surface 453 or one second hole forming surface 463. The plurality of bolt holes 44 are disposed to be evenly spaced apart. The bolt hole 44 is a hole formed in a circular shape slightly larger than the outer shape of the bolt 71 when viewed from the axial direction Da.

As shown in FIG. 3, the disk outer peripheral portion 42 protrudes outward from the disk shaft portion 41 in the radial direction Dr to extend from an outer edge of the disk shaft portion 41. The disk outer peripheral portion 42 is integrally formed with the disk shaft portion 41, thereby forming the disk 4 as one member.

The blade 34 extends from the disk outer peripheral portion 42 to the cover 35. A plurality of the blades 34 are disposed at intervals in the circumferential direction Dc around the axis O.

The cover 35 is disposed on the first side Da1 in the axial direction Da with respect to the disk outer peripheral portion 42 and the plurality of blades 34. The cover 35 has a disk shape and is formed to cover the plurality of blades 34. The disk outer peripheral portion 42, the blade 34, and the cover 35 form an impeller flow path 301 for circulating gas inside the impeller 30. The blade 34 and the cover 35 are formed at positions that overlap only the disk outer peripheral portion 42 when viewed from the axial direction Da, and do not overlap the disk shaft portion 41.

As shown in FIG. 2, in the present embodiment, the impeller 30 has a plurality of first impellers 31 and a second impeller 32. The first impellers 31 are a plurality of (three in the present embodiment) impellers 30 on the upstream side including the most upstream impeller 30 among the plurality of impellers 30. The second impeller 32 is disposed to be closest to the second side Da2 in the axial direction Da among the plurality of impellers 30. Therefore, the second impeller 32 is only the most downstream impeller 30. That is, the second impeller 32 is disposed on the second sides Da2 in the axial direction Da with respect to the plurality of first impellers 31. The first impeller 31 and the second impeller 32 have different shapes of the disk shaft portions 41.

The disk shaft portion 41 (hereinafter, referred to as first disk shaft portion 41A) of the first impeller 31 is formed in a columnar shape centered on the axis O. The first disk shaft portion 41A is formed so that a length in the axial direction Da is about the same as that of one diaphragm 22. That is, the first disk shaft portion 41A is formed to protrude from the blade 34 to the second side Da2 in the axial direction Da when viewed from the radial direction Dr. The first disk shaft portion 41A has two surfaces, a first disk surface 431 and a second disk surface 432, as the disk surface 43.

The first disk surface 431 is a flat surface facing the first side Da1 in the axial direction Da. The first disk surface 431 is formed in a circular shape centered on the axis O when viewed from the axial direction Da. The first fitting portion 45 is formed on the first disk surface 431.

The second disk surface 432 is a flat surface facing the second side Da2 in the axial direction Da. The second disk surface 432 is formed in a circular shape centered on the axis O when viewed from the axial direction Da. The second disk surface 432 is formed to have the same size as the first disk surface 431. The second fitting portion 46 is formed on the second disk surface 432.

The disk shaft portion 41 (hereinafter, referred to as second disk shaft portion 41B) of the second impeller 32 is formed in a columnar shape centered on the axis O. The second disk shaft portion 41B has a second disk shaft main body 48 and a second disk extension portion 49.

The second disk shaft main body 48 is formed in a columnar shape centered on the axis O. The second disk shaft main body 48 is formed so that a length in the axial direction Da is about the same as that of one diaphragm 22. The second disk shaft main body 48 has the same shape as the first disk shaft portion 41A. The second disk shaft main body 48 has only one surface of the first disk surface 431 as the disk surface 43. The second disk shaft main body 48 is formed with a first nut accommodating recessed portion 481 capable of accommodating a nut 72, which will be described below, on a surface facing the second side Da2 in the axial direction Da. The first nut accommodating recessed portion 481 is recessed from the surface of the second disk shaft main body 48 facing the second side Da2 in the axial direction Da toward the first side Da1 in the axial direction Da. A plurality of the first nut accommodating recessed portions 481 are formed at positions overlapping the bolt holes 44 when viewed from the axial direction Da. The first nut accommodating recessed portion 481 is formed in a circular shape larger than the bolt hole 44 centered on the bolt hole 44 when viewed from the axial direction Da.

The second disk extension portion 49 extends from the second disk shaft main body 48 toward the second side Da2 in the axial direction Da. The second disk extension portion 49 is formed in a columnar shape centered on the axis O and smaller than the second disk shaft main body 48 when viewed from the axial direction Da. That is, the second disk extension portion 49 is formed on the inner side in the radial direction Dr with respect to the first nut accommodating recessed portion 481 to be surrounded by the first nut accommodating recessed portion 481 when viewed from the axial direction Da. The second disk extension portion 49 is integrally formed with the second disk shaft main body 48 and is formed as one member. The second disk extension portion 49 is formed with a screw hole 491 for fixing the coupling hub 60 on the surface facing the second side Da2 in the axial direction Da.

The balance piston 50 is disposed on the first sides Da1 in the axial direction Da with respect to the plurality of impellers 30. The balance piston 50 of the present embodiment is adjacent to the most upstream impeller 30 (the first impeller 31 disposed to be closest to the first side Da1 among the plurality of first impellers 31). As shown in FIG. 1, the balance piston 50 is disposed at a position where the position in the axial direction Da overlaps with the suction-side head 231. As shown in FIG. 2, the balance piston 50 has a piston shaft portion 51, a pressure receiving portion 52, and a piston extension portion 53.

The piston shaft portion 51 is disposed to be in contact with the first impeller 31 disposed to be closest to the first side Da1 in the axial direction Da. The piston shaft portion 51 is formed in a columnar shape centered on the axis O. The piston shaft portion 51 has a first piston surface 54, a second piston surface 55, and a piston bolt hole 56.

The first piston surface 54 is a flat surface facing the first side Da1 in the axial direction Da. The first piston surface 54 is formed in an annular shape centered on the axis O when viewed from the axial direction Da. A second nut accommodating recessed portion 541 capable of accommodating the nut 72, which will be described below, is formed on the first piston surface 54. The second nut accommodating recessed portion 541 is recessed from the first piston surface 54 toward the second side Da2 in the axial direction Da. A plurality of the second nut accommodating recessed portions 541 are formed at positions overlapping the bolt holes 44 when viewed from the axial direction Da. The second nut accommodating recessed portion 541 is formed in a circular shape larger than the bolt hole 44 centered on the bolt hole 44 when viewed from the axial direction Da. That is, the second nut accommodating recessed portion 541 has the same shape as the first nut accommodating recessed portion 481.

The second piston surface 55 is a flat surface facing the second side Da2 in the axial direction Da. The second piston surface 55 faces the first disk surface 431 of the most upstream first impeller 31. That is, in a state where the balance piston 50 is fixed to the impeller 30, the second piston surface 55 and the first disk surface 431 of the first impeller 31 face each other in the axial direction Da. The second piston surface 55 is formed in a circular shape centered on the axis O when viewed from the axial direction Da. The second piston surface 55 is formed with a piston fitting portion 551 that is fitted into the first fitting portion 45. The piston fitting portion 551 is formed in an annular shape centered on the axis O to overlap the piston fitting portion 551 when viewed from the axial direction Da. The piston fitting portion 551 is formed to have the same shape as the second fitting portion 46. Therefore, the first fitting portion 45 of the first impeller 31 is fitted into the piston fitting portion 551 by shrink fitting or the like, and thus, the positions of the most upstream first impeller 31 and the balance piston 50 in the radial direction Dr are restricted.

The piston bolt hole 56 is formed to pass through the piston shaft portion 51 in the axial direction Da at a position deviated outward from the axis O in the radial direction Dr. The piston bolt hole 56 passes through from the first piston surface 54 to the second piston surface 55. The plurality of piston bolt holes 56 (eight piston bolt holes 56 in the present embodiment) are formed on the first piston surface 54 and the second piston surface 55 in the circumferential direction Dc centered on the axis O. The piston bolt hole 56 is a hole formed in a circular shape slightly larger than the outer shape of the bolt 71 when viewed from the axial direction Da. The piston bolt hole 56 of the present embodiment is formed to have the same position and shape as the bolt hole 44 when viewed from the axial direction Da.

The pressure receiving portion 52 protrudes in an annular shape outward from the piston shaft portion 51 in the radial direction Dr. The pressure receiving portion 52 protrudes outward in the radial direction Dr from a portion of the outer edge of the piston shaft portion 51. A length of the pressure receiving portion 52 in the axial direction Da is shorter than a length of the piston shaft portion 51 in the axial direction Da. The pressure receiving portion 52 is integrally formed with the piston shaft portion 51 and is formed as one member. The pressure receiving portion 52 has a first pressure receiving surface 521 and a second pressure receiving surface 522.

The first pressure receiving surface 521 is a flat surface facing the first side Da1 in the axial direction Da. The first pressure receiving surface 521 is formed in an annular shape centered on the axis O when viewed from the axial direction Da.

The second pressure receiving surface 522 is a flat surface facing the second side Da2 in the axial direction Da. The second pressure receiving surface 522 is formed in an annular shape centered on the axis O when viewed from the axial direction Da. The second pressure receiving surface 522 is formed so that the position of the radial direction Dr overlaps that of the first pressure receiving surface 521.

The piston extension portion 53 extends from the piston shaft portion 51 toward the first side Da1 in the axial direction Da. When viewed from the axial direction Da, the piston extension portion 53 is formed in a columnar shape centered on the axis O and smaller than the piston shaft portion 51. That is, the piston extension portion 53 is formed on the inner side in the radial direction Dr with respect to the second nut accommodating recessed portion 541 to be surrounded by the second nut accommodating recessed portion 541 when viewed from the axial direction Da. The piston extension portion 53 is integrally formed with the piston shaft portion 51 and is formed as one member. A thrust collar 531 protruding to the outside in the radial direction Dr is formed at a tip on the first side Da1 of the piston extension portion 53 in the axial direction Da.

The coupling hub 60 can be connected to a rotor 3 of another rotating machine such as a steam turbine or a motor. The coupling hub 60 is formed in a columnar shape centered on the axis O. A flange is formed at an end portion on the second side Da2 of the coupling hub 60 in the axial direction Da to protrude outward in the radial direction Dr. The coupling hub 60 is detachably fixed to the second impeller 32. Specifically, the coupling hub 60 is formed with a bolt insertion hole 61 that passes through the coupling hub 60 centered on the axis O. The coupling hub 60 is fixed to the second disk extension portion 49 by fixing a fixing bolt 62 inserted through the bolt insertion hole 61 to the screw hole 491 of the second disk extension portion 49.

The bolt fixing portion 70 fixes the plurality of impellers 30 arranged in the axial direction Da and the balance piston 50 together. The bolt fixing portion 70 has the bolt 71 and the pair of nuts 72. Like a stud bolt, the bolt 71 has no head and includes only a screw portion. The bolt 71 has a length in the axial direction Da so that an end portion reaches the first nut accommodating recessed portion 481 and the second nut accommodating recessed portion 541 in a state of being inserted into the bolt hole 44 and the piston bolt hole 56. The nut 72 is formed in a size that can be accommodated in the first nut accommodating recessed portion 481 and the second nut accommodating recessed portion 541. The pair of nuts 72 are removable from each other at both ends of the bolt 71.

As shown in FIG. 1, the seal portion 8 seals between the rotor 3 and the casing 2. The seal portion 8 of the present embodiment includes a first seal portion 81, a second seal portion 82, and a third seal portion 83.

The first seal portion 81 seals between an inner peripheral surface of the suction-side head 231 and an outer peripheral surface of the piston extension portion 53. The first seal portion 81 is a dry gas seal. The first seal portion 81 can be attached to or detached from the suction-side head 231 and the piston extension portion 53.

The second seal portion 82 seals between an inner peripheral surface of the discharge-side head 232 and an outer peripheral surface of the second disk extension portion 49. The second seal portion 82 is a dry gas seal. The second seal portion 82 can be attached to or detached from the discharge-side head 232 and the piston extension portion 53.

The third seal portion 83 seals between the inner peripheral surface of the suction-side head 231 and an outer peripheral surface of the pressure receiving portion 52. The third seal portion 83 is a labyrinth seal. The third seal portion 83 is disposed at a position separated to the second side Da2 in the axial direction Da with respect to the first seal portion 81. The third seal portion 83 is fixed to the suction-side head 231.

The bearing portion 9 rotatably supports the rotor 3 with respect to the casing 2 centered on the axis O. The bearing portion 9 of the present embodiment includes a first bearing portion 91, a second bearing portion 92, and a third bearing portion 93.

The first bearing portion 91 is a journal bearing that rotatably supports the piston extension portion 53. The first bearing portion 91 receives a load in the radial direction Dr acting on the end portion of the rotor 3 on the first side Da1 in the axial direction Da.

The second bearing portion 92 is a journal bearing that rotatably supports the second disk extension portion 49. The second bearing portion 92 receives a load in the radial direction Dr acting on the end portion of the rotor 3 on the second side Da2 in the axial direction Da. The second bearing portion 92 is attached to the inside of the bearing holder 95 having a cylindrical shape. The bearing holder 95 is fixed to the discharge-side head 232 by using a detachable fixing means such as a bolt 71. Further, by removing the bearing holder 95 from the discharge-side head 232, the second seal portion 82 can be moved to the outside with respect to the discharge-side head 232.

The third bearing portion 93 is a thrust bearing that rotatably supports the thrust collar 531 of the piston extension portion 53. The third bearing portion 93 receives a load acting on the rotor 3 in the axial direction Da. The third bearing portion 93 is attached to the inside of the bearing cover 96 having a box shape together with the first bearing portion 91. The bearing cover 96 is fixed to the suction-side head 231 by using a removable fixing means such as a bolt 71.

(Action Effect)

In the compressor 1 provided with the rotor 3 having the above configuration, a load due to a centrifugal force according to the rotation of the rotor 3 increases toward the inner side in the radial direction Dr, and a thrust force in the axial direction Da is also generated in the impeller 30 by the compressed gas. In the rotor 3 of the present embodiment, the first fitting portion 45 of one impeller 30 and the second fitting portion 46 of another adjacent impeller 30 are formed at overlapping positions. As a result, the first protrusion portion 451 of the one impeller 30 is fitted into the second recessed portion 462 of the other adjacent impeller 30, and the first recessed portion 452 of the one impeller 30 is fitted into the second protrusion portion 461 of the other adjacent impeller 30. That is, the first protrusion portion 451 and the first recessed portion 452, and the second protrusion portion 461 and the second recessed portion 462 restrict the movements of the adjacent impellers 30 in the circumferential direction Dc to each other. In this state, the plurality of impellers 30 are collectively fixed by the bolt 71 inserted into the bolt hole 44 that passes through the first fitting portion 45 and the second fitting portion 46 in the axial direction Da. Therefore, the load toward the outer side in the radial direction Dr and the axial direction Da generated around the bolt hole 44 can be stably received on the peripheral surfaces of the bolt holes 44 of the first fitting portion 45 and the second fitting portion 46. Accordingly, torque is stably transmitted between the impellers 30, and even when the rotor 3 is rotated at high speed without a shaft, it is possible to prevent the impellers 30 from shifting from each other. As a result, the strength of the impeller 30 against the load due to centrifugal force can be improved while the rotor 3 is stably rotated at high speed.

Additionally, the impeller 30 has a solid structure including the disk shaft portion 41. That is, the impeller 30 is not a structure that is fixed to an outer peripheral surface of a shaft by shrink fitting or the like. Therefore, a large hole for inserting the shaft is not formed in the center of the impeller 30. Then, in a state where the plurality of first impellers 31 and second impellers 32, which are solid impellers 30, are stacked in the axial direction Da, the balance piston 50 is further stacked in the axial direction Da. Both ends of the bolt 71 inserted into the bolt hole 44 and the piston bolt hole 56 are tightened and fixed to the plurality of stacked first impeller 31, the second impeller 32, and the balance piston 50 with nuts 72, and thus, the rotor 3 is formed. When such a rotor 3 is rotated, the impeller 30 does not have a large hole, and thus, strength of the impeller 30 against a load generated by centrifugal force can be greatly improved.

In addition, the positions in the circumferential direction Dc of the first impellers 31 arranged in the axial direction Da or the first impeller 31 and the second impeller 32 are restricted by fitting the first protrusion portion 451 and the first recessed portion 452, and the second protrusion portion 461 and the second recessed portion 462 to each other. Since the plurality of second protrusion portions 461 and second recessed portions 462 of the first protrusion portion 451 and the first recessed portion 452 are provided, when the first protrusion portion 451 and the first recessed portion 452 and the second protrusion portion 461 and the second recessed portion 462 are fitted to each other, the positions in the radial direction Dr of the first impellers 31 arranged in the axial direction Da or the first impeller 31 and the second impeller 32 are also restricted. Therefore, before the position is completely fixed by the bolt 71, the positions of the first impellers 31 in the radial direction Dr and the positions of the second impeller 32 and the first impeller 31 in the radial direction Dr can be aligned. As a result, centering can be easily performed when the plurality of impellers 30 are stacked in the axial direction Da. Accordingly, workability when assembling the rotor 3 can be improved.

In addition, the first hole forming surface 453 and the second hole forming surface 463 in which the bolt hole 44 is formed face each other. Therefore, even when a large load is applied to the periphery of the bolt hole 44 and the first hole forming surface 453 and the second hole forming surface 463 are in contact with each other, a surface pressure around the bolt hole 44 can be ensured by the first hole forming surface 453 and the second hole forming surface 463. As a result, the load on the outer side in the radial direction Dr and toward the axial direction Da, which is generated around the bolt hole 44, can be stably received by the first hole forming surface 453 and the second hole forming surface 463.

In addition, the first connection surface 455 is in contact with the second connection surface 465 of another adjacent impeller 30. That is, the first protrusion portion 451 and the first recessed portion 452, and the second protrusion portion 461 and the second recessed portion 462 are in a state of being immovable in the circumferential direction Dc by the first connection surface 455 and the second connection surface 465. Therefore, before the position is completely fixed by the bolt 71, the positions of the first impellers 31 in the radial direction Dr and the positions of the second impeller 32 and the first impeller 31 in the radial direction Dr can be aligned more accurately. As a result, the centering can be easily performed with high accuracy when the plurality of impellers 30 are stacked in the axial direction Da. Accordingly, workability when assembling the rotor 3 can be greatly improved.

In addition, the plurality of first connection surfaces 455 and the plurality of second connection surfaces 465 are formed as flat surfaces so that the connection lines with other surfaces are linear. As a result, the first hole forming surface 453 and the first separation surface 454 are connected by the first connection surface 455 which is a flat surface. Similarly, the second hole forming surface 463 and the second separation surface 464 are connected by the second connection surface 465 which is a flat surface. That is, the first protrusion portion 451 and the first recessed portion 452 or the second protrusion portion 461 and the second recessed portion 462 are formed in a shape like a Hirth coupling. Therefore, the first connection surface 455 and the second connection surface 465 are formed as flat surfaces that are linear toward the axis O when viewed from the radial direction Dr. As a result, the first connection surface 455 and the second connection surface 465 can be easily processed, and workability during manufacturing of the impeller 30 can be improved.

Further, the disk 4 is formed with the first central recessed portion 471 that is recessed to the inner side in the radial direction Dr with respect to the first protrusion portion 451 and the first recessed portion 452, and the second central recessed portion 472 that is recessed to the inner side in the radial direction Dr with respect to the second protrusion portion 461 and the second recessed portion 462. Therefore, a space is formed on the inner side in the radial direction Dr with respect to the first protrusion portion 451 and the first recessed portion 452 or the second protrusion portion 461 and the second recessed portion 462. Therefore, when the first protrusion portion 451 and the first recessed portion 452 or the second protrusion portion 461 and the second recessed portion 462 are created by cutting out from the material, it is possible to prevent the inner region of the disk 4 from interfering with a tool. Accordingly, the first protrusion portion 451 and the first recessed portion 452, or the second protrusion portion 461 and the second recessed portion 462 can be more easily processed, and workability during manufacturing of the impeller 30 can be improved.

Second Embodiment

Next, a second embodiment of the compressor according to the present disclosure will be described. In the second embodiment described below, the same reference numerals are given in the drawings to the configurations common to the first embodiment, and descriptions thereof will be omitted. In the second embodiment, the shapes of the first fitting portion and the second fitting portion are different from those in the first embodiment.

Figure 8:
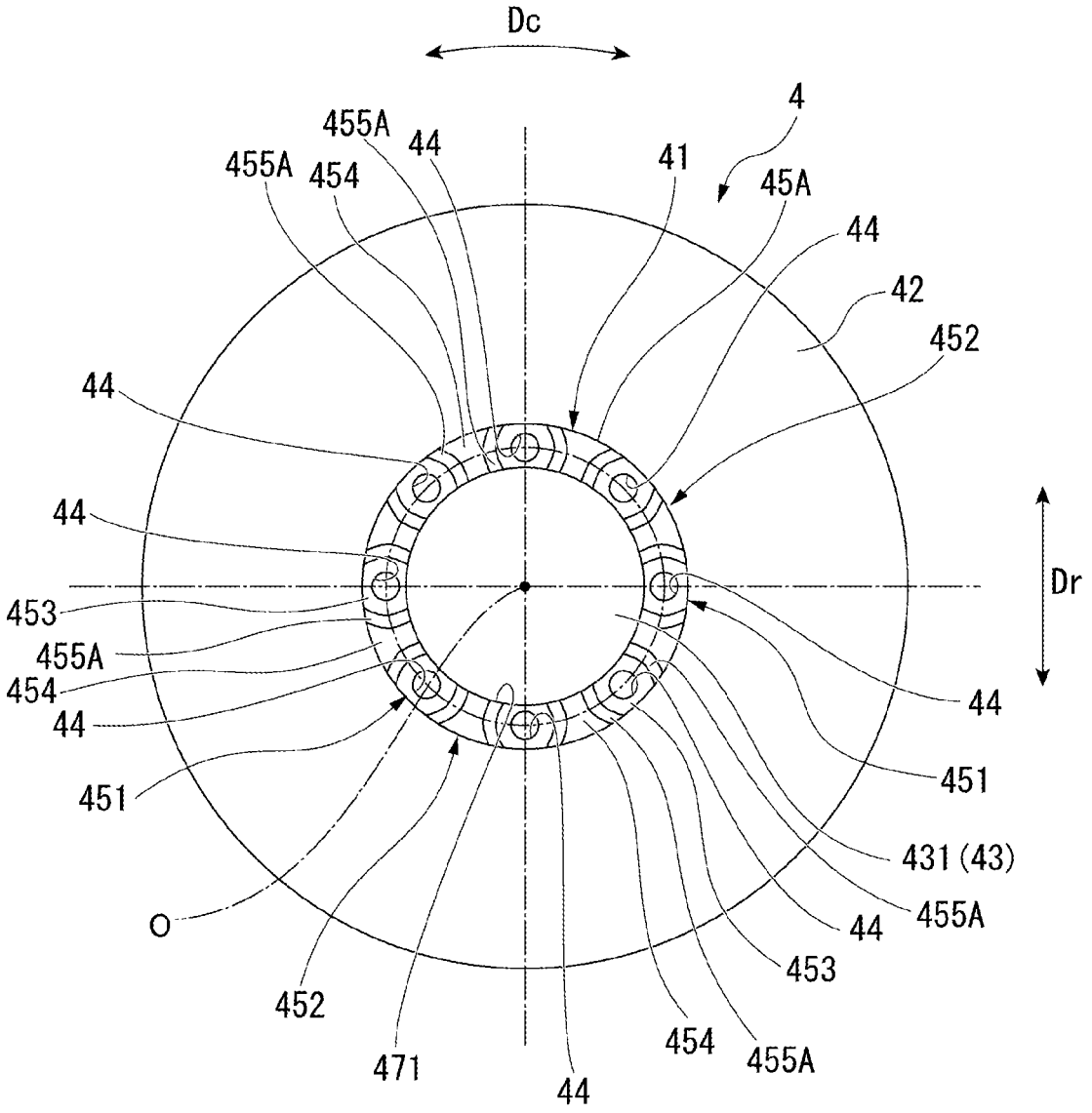
FIG. 8 is a view showing a state where a disk portion of a first impeller of a second embodiment is viewed from the first side in the axial direction.
Figure 9:
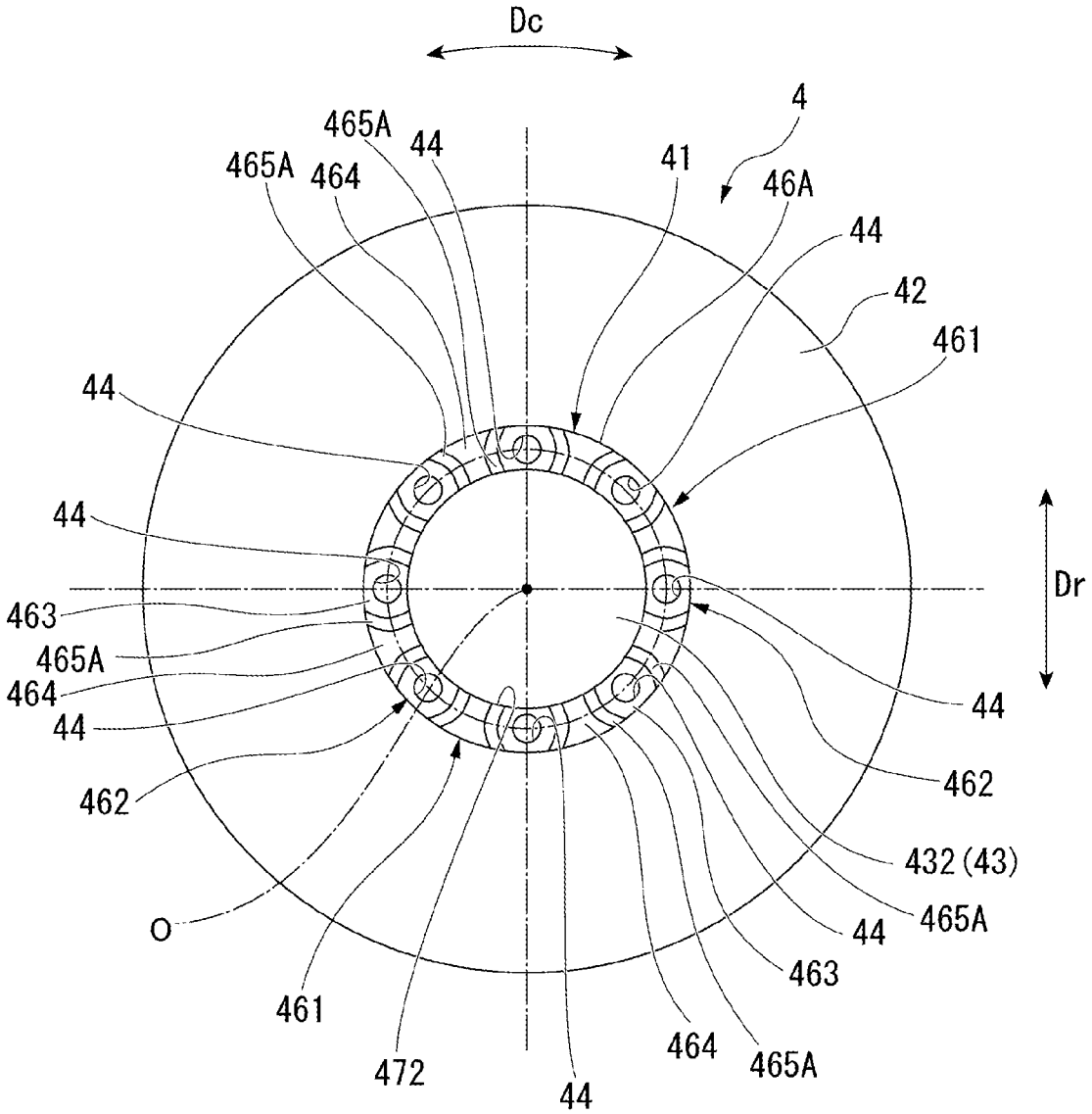
FIG. 9 is a view showing a state where the disk portion of the first impeller of the second embodiment is viewed from the second side in the axial direction.

Specifically, as shown in FIGS. 8 and 9, in the second embodiment, the shapes of a first connection surface 455A and a second connection surface 465A are different. As shown in FIG. 8, when viewed from the axial direction Da, the first connection surface 455A of the second embodiment is formed as a curved surface so that the connection line with the first hole forming surface 453 and the connection line with the first separation surface 454 are curved. That is, the first connection surface 455A is a curved surface facing the axial direction Da and the circumferential direction Dc. The first connection surface 455A is a convex curved surface curved to protrude most in the circumferential direction Dc near the center of the radial direction Dr when viewed from the axial direction Da.

In addition, in the first fitting portion 45A, the first hole forming surface 453, the curved first connection surface 455A, the first separation surface 454, the curved first connection surface 455A, and the first hole forming surface 453 are repeatedly arranged in this order in the circumferential direction Dc. Therefore, the plurality of first protrusion portions 451 and the plurality of first recessed portions 452 are formed in a shape like a Curvic coupling.

Similarly, as shown in FIG. 9, when viewed from the axial direction Da, the second connection surface 465A is formed as a curved surface so that the connection line with the second hole forming surface 463 and the connection line with the second separation surface 464 are curved. That is, the second connection surface 465A is a curved surface facing the axial direction Da and the circumferential direction Dc. The second connection surface 465A is a concave curved surface curved to be recessed most in the circumferential direction Dc near the center of the radial direction Dr when viewed from the axial direction Da.

In addition, in the second fitting portion 46A, the second hole forming surface 463, the curved second connection surface 465A, the second separation surface 464, the curved second connection surface 465A, and the second hole forming surface 463 are repeatedly arranged in this order in the circumferential direction Dc. Therefore, the plurality of second protrusion portions 461 and the plurality of second recessed portions 462 are formed in a shape like a Curvic coupling.

(Action Effect)

With the above configuration, the plurality of first connection surfaces 455A and the plurality of second connection surfaces 465A are formed as curved surfaces so that the connection lines with other surfaces are curved. As a result, the first hole forming surface 453 and the first separation surface 454 are connected by the first connection surface 455A which is a curved surface. Similarly, the second hole forming surface 463 and the second separation surface 464 are connected by the second connection surface 465A which is a curved surface. That is, the first protrusion portion 451 and the first recessed portion 452 or the second protrusion portion 461 and the second recessed portion 462 are formed in a shape similar to a Curvic coupling. Therefore, when the plurality of impellers 30 are stacked in the axial direction Da, centering can be easily performed with high accuracy. Accordingly, workability when assembling the rotor 3 can be greatly improved.

Other Embodiments

As described above, the embodiment of the present disclosure is described in detail with reference to the drawings. However, the specific configurations are not limited to the embodiment, and include a design modification or the like within a scope which does not depart from the gist of the present disclosure.

A rotating machine including the rotor 3 is not limited to the compressor 1. The rotating machine including the rotor 3 may be, for example, a steam turbine.

Further, the number of the impellers 30 included in the rotor 3 is not limited to four as in the embodiment, and may be two or more. Therefore, for example, the number of the impellers 30 included in the rotor 3 may be five or more.

In addition, each of the number of the first protrusion portions 451 and the number of the first recessed portions 452 included in the first fitting portion 45 and each of the number of the second protrusion portions 461 and the number of the second recessed portions 462 included in the second fitting portion 46 are not limited to eight as in the embodiment. Each of the number of the first protrusion portions 451 and the number of the first recessed portions 452 and each of the number of the second protrusion portions 461 and the number of the second recessed portions 462 may be seven or less, or nine or more. Further, the first protrusion portion 451 and the first recessed portion 452, and the second protrusion portion 461 and the second recessed portion 462 are not limited to being evenly disposed in the circumferential direction Dc.

Further, the bolt hole 44 is not limited to being formed only on the first hole forming surface 453 and the second hole forming surface 463. The bolt hole 44 may be formed for the first fitting portion 45 and the second fitting portion 46. Therefore, the bolt hole 44 may be further formed on the first separation surface 454, the first connection surface 455, the second separation surface 464, or the second connection surface 465. Further, the present invention is not limited to only one bolt hole 44 being formed for one first hole forming surface 453 or one second hole forming surface 463. A plurality of the bolt holes 44 may be formed in one first hole forming surface 453 or the second hole forming surface 463.

<Additional Notes>

The rotor 3 and the compressor 1 described in the embodiments are grasped as follows, for example.

(1) According to a first aspect, there is provided a rotor 3 rotatable about an axis O, including: a plurality of impellers 30 that each include a disk 4 having a central shaft structure having a buried center and formed in a disk shape centered on the axis O, and are adjacent to each other in an axial direction Da in which the axis O extends; and a bolt fixing portion 70 having a plurality of bolts 71 that collectively fix the plurality of impellers 30 arranged in the axial direction Da, in which the disk 4 includes a first fitting portion 45, 45A having a plurality of first protrusion portions 451 that protrude in the axial direction Da from a surface facing a first side Da1 in the axial direction Da and a plurality of first recessed portions 452 that are recessed in the axial direction Da from the surface facing a first side Da1 in the axial direction Da, a second fitting portion 46, 46A that is formed at a position overlapping the first fitting portion 45, 45A when viewed from the axial direction Da and has a plurality of second protrusion portions 461 that protrude in the axial direction Da from a surface facing a second side Da2 in the axial direction Da and a plurality of second recessed portions 462 that are recessed in the axial direction Da from the surface facing a second side Da2 in the axial direction Da, and a plurality of bolt holes 44 which is formed so that the first fitting portion 45, 45A and the second fitting portion 46, 46A pass through in the axial direction Da and through which the bolt 71 is inserted, each of the plurality of first protrusion portions 451 and each of the plurality of first recessed portions 452 are disposed alternately in a circumferential direction Dc centered on the axis O at a position deviated from the axis O when viewed in the axial direction Da, each of the plurality of second protrusion portions 461 and each of plurality of second recessed portions 462 are disposed alternately in the circumferential direction Dc at a position deviated from the axis O when viewed from the axial direction Da, each of the plurality of first protrusion portions 451 is fitted into each of the plurality of second recessed portions 462 of another adjacent impeller 30 in a state where movement in the circumferential direction Dc is restricted to each other, and each of the plurality of first recessed portions 452 is fitted into each of the plurality of second protrusion portions 461 of another adjacent impeller 30 in a state where movement in the circumferential direction Dc is restricted to each other.

Accordingly, the first protrusion portion 451 and the first recessed portion 452, and the second protrusion portion 461 and the second recessed portion 462 restrict the movements of the adjacent impellers 30 in the circumferential direction Dc to each other. In this state, the plurality of impellers 30 are collectively fixed by the bolt 71 inserted into the bolt hole 44 that passes through the first fitting portion 45, 45A and the second fitting portion 46, 46A in the axial direction Da. Therefore, the load toward the outer side in the radial direction Dr and the axial direction Da generated around the bolt hole 44 can be stably received on the peripheral surfaces of the bolt holes 44 of the first fitting portion 45, 45A and the second fitting portion 46, 46A. Accordingly, torque is stably transmitted between the impellers 30, and even when the rotor 3 is rotated at high speed without a shaft, it is possible to prevent the impellers 30 from shifting from each other. As a result, the strength of the impeller 30 against the load due to centrifugal force can be improved while the rotor 3 is stably rotated at high speed.

(2) In the rotor 3 according to a second aspect, in the rotor 3 of (1), the first fitting portion 45, 45A includes a plurality of first hole forming surfaces 453 on which each of the plurality of bolt holes 44 is formed, a plurality of first separation surfaces 454 that are disposed at a distance in the circumferential direction Dc to be arranged alternately with respect to each of the plurality of first hole forming surfaces 453 when viewed from the axial direction Da and formed at a position shifted in the axial direction Da with respect to each of the plurality of first hole forming surfaces 453, and a plurality of first connection surfaces 455, 455A that are disposed between each of the plurality of first hole forming surfaces 453 and each of the plurality of first separation surfaces 454 in the circumferential direction Dc and connecting each of the plurality of first hole forming surfaces 453 and each of the plurality of first separation surfaces 454, the second fitting portion 46, 46A includes a plurality of second hole forming surfaces 463 which are disposed at a position overlapping each of the plurality of first hole forming surfaces 453 when viewed from the axial direction Da and on which each of the plurality of bolt holes 44 is formed, a plurality of second separation surfaces 464 which are disposed at a position overlapping each of the plurality of first separation surfaces 454 when viewed from the axial direction Da and formed at a position shifted in the axial direction Da with respect to each of the plurality of second hole forming surfaces 463, and a plurality of second connection surfaces 465, 465A which are disposed at a position overlapping each of the plurality of first connection surfaces 455 when viewed from the axial direction Da and connect each of the plurality of second hole forming surfaces 463 and each of the plurality of second separation surfaces 464, and the plurality of first hole forming surfaces 453 and the plurality of second hole forming surfaces 463 of another adjacent impeller 30 face each other.

Accordingly, the surface pressure around the bolt hole 44 can be secured by the first hole forming surface 453 and the second hole forming surface 463. As a result, the load on the outer side in the radial direction Dr and toward the axial direction Da, which is generated around the bolt hole 44, can be stably received by the first hole forming surface 453 and the second hole forming surface 463.

(3) In the rotor 3 according to a third aspect, in the rotor 3 of (2), at least a part of the plurality of first connection surfaces 455, 455A comes into contact with the plurality of second connection surfaces 465, 465A of the other adjacent impellers 30.

As a result, the first protrusion portion 451 and the first recessed portion 452, and the second protrusion portion 461 and the second recessed portion 462 are in a state of being immovable in the circumferential direction Dc by the first connection surface 455, 455A and the second connection surface 465, 465A. Therefore, before the position is completely fixed by the bolt 71, the positions of the first impellers 31 in the radial direction Dr and the positions of the second impeller 32 and the first impeller 31 in the radial direction Dr can be aligned more accurately. As a result, the centering can be easily performed with high accuracy when the plurality of impellers 30 are stacked in the axial direction Da. Accordingly, workability when assembling the rotor 3 can be greatly improved.

(4) In the rotor 3 according to a fourth aspect, in the rotor 3 of (2) or (3), the plurality of first connection surfaces 455 are formed as flat surfaces so that a connection line with each of the plurality of first hole forming surfaces 453 and a connection line with each of the plurality of first separation surfaces 454 are linear when viewed from the axial direction Da, and the plurality of second connection surfaces 465 are formed as flat surfaces so that a connection line with each of the plurality of second hole forming surfaces 463 and a connection line with each of the plurality of second separation surfaces 464 are linear when viewed from the axial direction Da.

Accordingly, the first protrusion portion 451 and the first recessed portion 452, or the second protrusion portion 461 and the second recessed portion 462 are formed in a shape like a Hirth coupling. Therefore, the first connection surface 455 and the second connection surface 465 are formed as flat surfaces that are linear toward the axis O when viewed from the radial direction Dr. As a result, the first connection surface 455 and the second connection surface 465 can be easily processed, and workability during manufacturing of the impeller 30 can be improved.

(5) In the rotor 3 according to a fifth aspect, in the rotor 3 of (2) or (3), the plurality of first connection surfaces 455A are formed as curved surfaces so that a connection line with each of the plurality of first hole forming surfaces 453 and a connection line with each of the plurality of first separation surfaces 454 are curved when viewed from the axial direction Da, and the plurality of second connection surfaces 465A are formed as curved surfaces so that a connection line with each of the plurality of second hole forming surfaces 463 and a connection line with each of the plurality of second separation surfaces 464 are curved when viewed from the axial direction Da.

Accordingly, the first protrusion portion 451 and the first recessed portion 452, or the second protrusion portion 461 and the second recessed portion 462 are formed in a shape like the Curvic coupling. Therefore, when the plurality of impellers 30 are stacked in the axial direction Da, centering can be easily performed with high accuracy. Accordingly, workability when assembling the rotor 3 can be greatly improved.

(6) In the rotor 3 according to a sixth aspect, in the rotor 3 of any one of (1) to (5), the disk 4 includes a first central recessed portion 471 in which an inner region in a radial direction Dr with reference to the axis O with respect to each of the plurality of first protrusion portions 451 and each of the plurality of first recessed portions 452 is recessed in the axial direction Da with respect to each of the plurality of first recessed portions 452 when viewed from the axial direction Da, and a second central recessed portion 472 in which an inner region in the radial direction Dr with respect to each of the plurality of second protrusion portions 461 and each of the plurality of second recessed portions 462 is recessed in the axial direction Da with respect to each of the plurality of second recessed portions 462 when viewed from the axial direction Da.

Accordingly, a space is formed on the inner side in the radial direction Dr with respect to the first protrusion portion 451 and the first recessed portion 452 or the second protrusion portion 461 and the second recessed portion 462. Therefore, when the first protrusion portion 451 and the first recessed portion 452 or the second protrusion portion 461 and the second recessed portion 462 are created by cutting out from the material, it is possible to prevent the inner region of the disk 4 from interfering with a tool. Accordingly, the first protrusion portion 451 and the first recessed portion 452, or the second protrusion portion 461 and the second recessed portion 462 can be more easily processed, and workability during manufacturing of the impeller 30 can be improved.

(7) According to a seventh aspect, there is provided a compressor 1 including: the rotor 3 of any one of (1) to (6); and a casing 2 configured to cover the rotor 3 from an outside in a radial direction Dr with reference to the axis O.

INDUSTRIAL APPLICABILITY

According to the rotor and compressor of the present disclosure, it is possible to improve strength of the impeller against a load due to a centrifugal force while rotating the rotor stably at high speed.

EXPLANATION OF REFERENCES

1: compressor
2: casing
21: outer casing
211: end plate
212: insertion hole

22: diaphragm
221: suction port
222: casing flow path
223: discharge port
23: head
231: suction-side head
232: discharge-side head
3: rotor
30: impeller
31: first impeller
32: second impeller
4: disk
41: disk shaft portion
42: disk outer peripheral portion
43: disk surface
45, 45A: first fitting portion
451: first protrusion portion
452: first recessed portion
453: first hole forming surface
454: first separation surface
455, 455A: first connection surface
471: first central recessed portion
46, 46A: second fitting portion
461: second protrusion portion
462: second recessed portion
463: second hole forming surface
464: second separation surface
465, 465A: second connection surface
472: second central recessed portion
44: bolt hole
34: blade
35: cover
301: impeller flow path
41A: first disk shaft portion
41B: second disk shaft portion
431: first disk surface
432: second disk surface
48: second disk shaft main body
481: first nut accommodating recessed portion
49: second disk extension portion
491: screw hole
50: balance piston
51: piston shaft portion
54: first piston surface
541: second nut accommodating recessed portion
55: second piston surface
551: piston fitting portion
56: piston bolt hole
52: pressure receiving portion
521: first pressure receiving surface
522: second pressure receiving surface
53: piston extension portion
531: thrust collar
60: coupling hub
61: bolt insertion hole
62: fixing bolt
70: bolt fixing portion
71: bolt
72: nut
8: seal portion
81: first seal portion
82: second seal portion
83: third seal portion
9: bearing portion
91: first bearing portion
92: second bearing portion
95: bearing holder
93 third bearing portion
96: bearing cover
100: bundle
O: axis
Da: axial direction
Da1: first side
Da2: second side
Dr: radial direction
Dc: circumferential direction

What is claimed is:

1. A rotor rotatable about an axis, comprising:
impellers that:
each include a disk centered on the axis, and
are adjacent to each other in an axial direction in which the axis extends; and
a bolt fixing portion having bolts that collectively fix the impellers arranged in the axial direction, wherein
the disk comprises:
a first fitting portion comprising:
first protrusion portions that protrude in the axial direction from a surface facing a first side in the axial direction;
first recessed portions that are recessed in the axial direction from the surface facing the first side in the axial direction;
first hole forming surfaces that face the first side in the axial direction;
first separation surf aces formed at a position shifted in the axial direction with respect to the first hole forming surfaces, wherein
when viewed from the axial direction, the first separation surfaces and the first hole forming surfaces are alternately disposed along a circumferential direction; and
first connection surf aces that connect the first hole forming surfaces to the first separation surfaces, wherein each of the first connection surfaces is disposed between respective ones of the first hole forming surfaces and the first separation surfaces in the circumferential direction; and
a second fitting portion formed at a position overlapping the first fitting portion when viewed from the axial direction and comprising:
second protrusion portions that protrude in the axial direction from a surface facing a second side in the axial direction;
second recessed portions that are recessed in the axial direction from the surface facing the second side in the axial direction;
second hole forming surf aces that face the second side in the axial direction;
second separation surfaces formed at a position shifted in the axial direction with respect to the second hole forming surfaces, wherein
when viewed from the axial direction, each of the second separation surfaces is disposed at a position overlapping each of the first separation surfaces; and
second connection surfaces that connect the second hole forming surfaces to the second separation surfaces, wherein
when viewed from the axial direction, each of the second connection surfaces is disposed at a position overlapping each of the first connection surfaces, each of the second hole forming surfaces overlaps a corresponding one of the first hole forming surfaces when viewed from the axial direction, the disk has bolt holes into which bolts that pass through the first fitting portion and the second fitting portion in the axial direction are inserted, wherein each of the bolt holes is accommodated within a corresponding one of the first hole forming surfaces in the first fitting portion and within a corresponding one of the second hole forming surfaces in the second fitting portion, each of the first protrusion portions and each of the first recessed portions are disposed alternately in the circumferential direction centered on the axis at a position deviated from the axis when viewed in the axial direction, each of the second protrusion portions and each of the second recessed portions are disposed alternately in the circumferential direction at a position deviated from the axis when viewed from the axial direction, each of the first protrusion portions is fitted into each of the second recessed portions of another adjacent impeller in a state where movement in the circumferential direction is restricted to each other, and each of the first recessed portions is fitted into each of the second protrusion portions of another adjacent impeller in a state where movement in the circumferential direction is restricted to each other.

2. The rotor according to claim 1, wherein the first hole forming surfaces and the second hole forming surfaces of another adjacent impeller face each other.

3. The rotor according to claim 2, wherein at least a part of the first connection surfaces comes into contact with the second connection surfaces of the other adjacent impellers.

4. The rotor according to claim 2, wherein the first connection surfaces are flat such that a connection line with each of the first hole forming surfaces and a connection line with each of the first separation surfaces are straight when viewed from the axial direction, and the second connection surfaces are flat such that a connection line with each of the second hole forming surfaces and a connection line with each of the second separation surfaces are straight when viewed from the axial direction.

5. The rotor according to claim 2, wherein the first connection surfaces are curved such that a connection line with each of the first hole forming surfaces and a connection line with each of the first separation surfaces are curved when viewed from the axial direction, and the second connection surfaces are curved such that a connection line with each of the second hole forming surfaces and a connection line with each of the second separation surfaces are curved when viewed from the axial direction.

6. The rotor according to claim 1, wherein the disk further comprises:

a first central recessed portion that is disposed radially inward with respect to each of the first protrusion portions and each of the first recessed portions and that is recessed in the axial direction with respect to each of the first recessed portions; and a second central recessed portion that is disposed radially inward with respect to each of the second protrusion portions and each of the second recessed portions and that is recessed in the axial direction with respect to each of the second recessed portions.

7. A compressor comprising:

the rotor according to claim 1; and a casing configured to cover the rotor from an outside in a radial direction with reference to the axis.

* * * * *